US009672777B2

(12) United States Patent
Ji et al.

(10) Patent No.: US 9,672,777 B2
(45) Date of Patent: Jun. 6, 2017

(54) LIQUID CRYSTAL DISPLAY PANEL AND DRIVING METHOD THEREOF

(71) Applicant: Shenzhen China Star Optoelectronics Technology Co., Ltd., Shenzhen, Guangdong (CN)

(72) Inventors: Feilin Ji, Guangdong (CN); Wei Chen, Guangdong (CN); Xiaoping Tan, Guangdong (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 298 days.

(21) Appl. No.: 14/433,639

(22) PCT Filed: Jan. 6, 2015

(86) PCT No.: PCT/CN2015/070186

§ 371 (c)(1),
(2) Date: Apr. 3, 2015

(87) PCT Pub. No.: WO2016/106789

PCT Pub. Date: Jul. 7, 2016

(65) Prior Publication Data

US 2016/0343313 A1 Nov. 24, 2016

(30) Foreign Application Priority Data

Dec. 29, 2014 (CN) ..... 2014 1 0843269

(51) Int. Cl.
*G09G 3/36* (2006.01)
*G09G 3/20* (2006.01)

(52) U.S. Cl.
CPC ..... *G09G 3/3607* (2013.01); *G09G 3/2003* (2013.01); *G09G 3/2074* (2013.01);
(Continued)

(58) Field of Classification Search
CPC ..... G09G 2300/0452; G09G 2340/06; G09G 3/2003; G09G 3/3607; G09G 2320/0242; G09G 2320/0666; G09G 5/02
(Continued)

(56) References Cited

U.S. PATENT DOCUMENTS 6,278,434 B1 * 8/2001 Hill ..... G02F 1/133514 345/468
6,771,028 B1 8/2004 Winters
(Continued)

FOREIGN PATENT DOCUMENTS

CN 101452671 A 6/2009
CN 203250515 U 10/2013
CN 103955079 A 7/2014

*Primary Examiner* — Koosha Sharifi-Tafreshi
(74) *Attorney, Agent, or Firm* — Andrew C. Cheng

(57) ABSTRACT

A liquid crystal display (LCD) panel and a driving method thereof are provided. The LCD panel includes display pixels each including RGBW display sub-pixels. The method includes: receiving an image data for representing a to-be-displayed image including image pixels; calculating RGBW image sub-pixel data corresponding to the image pixels according to the image data; using a first predetermined number of image pixels as a repeat unit and generating RGBW display sub-pixel data corresponding to a second predetermined number of display pixels by using each repeat unit in a pixel sharing manner, the first predetermined number being greater than the second predetermined number; and using the RGBW display sub-pixel data to drive RGBW display sub-pixels of corresponding display pixels. Accordingly, the edge blur phenomenon can be effectively improved by the image pixel sharing.

12 Claims, 3 Drawing Sheets

(52) U.S. Cl.
CPC ..... *G09G 3/36* (2013.01); *G09G 2300/0452* (2013.01); *G09G 2320/0257* (2013.01); *G09G 2340/06* (2013.01)

(58) Field of Classification Search
USPC ..... 345/88, 89, 589, 690
See application file for complete search history.

(56) References Cited

U.S. PATENT DOCUMENTS

| | | | | |
|---|---|---|---|---|
| 8,896,509 | B2 | 11/2014 | An et al. | |
| 2005/0073487 | A1 | 4/2005 | Matsumoto | |
| 2007/0002084 | A1 | 1/2007 | Kimura et al. | |
| 2009/0051638 | A1 | 2/2009 | Horiuchi et al. | |
| 2010/0295763 | A1 | 11/2010 | Chen et al. | |
| 2012/0206512 | A1* | 8/2012 | Kim | G02F 1/133514 345/691 |
| 2015/0035847 | A1* | 2/2015 | Park | G09G 3/2003 345/589 |

* cited by examiner

| | | | | | | | | | | | |
|---|---|---|---|---|---|---|---|---|---|---|---|
| R | G | B | R | G | B | R | G | B | R | G | B |
| R | G | B | R | G | B | R | G | B | R | G | B |
| R | G | B | R | G | B | R | G | B | R | G | B |
| R | G | B | R | G | B | R | G | B | R | G | B |

FIG. 1 (Prior Art)

| | | | | | | | | | | | |
|---|---|---|---|---|---|---|---|---|---|---|---|
| R | G | B | W | R | G | B | W | R | G | B | W |
| B | W | R | G | B | W | R | G | B | W | R | G |
| R | G | B | W | R | G | B | W | R | G | B | W |
| B | W | R | G | B | W | R | G | B | W | R | G |

FIG. 2 (Prior Art)

LIQUID CRYSTAL DISPLAY PANEL AND DRIVING METHOD THEREOF

TECHNICAL FIELD

The invention relates to the field of display driving technology, and particularly to a liquid crystal display panel and a driving method thereof.

DESCRIPTION OF RELATED ART

Current liquid crystal display panels are increasingly seeking high resolution, and the high resolution correspondingly requires much more pixels. When the number of pixels is increased, the light transmittance of screen will become lower, only the increase of backlight brightness can maintain the original brightness of the display panel in the case of high-resolution, but the increase of backlight brightness would cause the increase of product cost and arise many problems at the aspects of power consumption, heat generation of product and so on.

Based on the above considerations, white sub-pixels are added in the display panel with the RGB pixel structure as shown in FIG. 1 (i.e., a RGBW pixel structure as shown in FIG. 2 is obtained) so as to increase the transmittance of the display panel, and about one-third brightness can be increased. Therefore, if wanting to obtain a same brightness as the RGB display panel, the RGBW pixel structure can reduce one-third backlight brightness and correspondingly one-third backlight power consumption can be reduced. Herein, FIG. 1 is a schematic view of RGB pixel arrangement of a first liquid crystal display panel in the prior art, and FIG. 2 is a RGBW pixel arrangement of a second liquid crystal display panel in the prior art.

However, because the RGBW display panel is added with W sub-pixels, compared with the RGB display panel, one-third sub-pixels would be increased for a same resolution, the size of sub-pixel for a same-sized display panel would be reduced, and correspondingly the process requirements would become higher, so that at a same production condition, the process yield problem would become more serious, the cost is increased in disguise, and more serious edge blur problem would be caused.

SUMMARY

Accordingly, the invention provides a liquid crystal display panel and a driving method thereof, so as to overcome the edge blur problem in the prior art.

In order to solve the above problem, the invention provides a driving method of a liquid crystal display panel. The liquid crystal display panel includes a plurality of display pixels, and each of the plurality of display pixels includes a red display sub-pixel, a green display sub-pixel, a blue display sub-pixel and a white display sub-pixel. The driving method includes: receiving image data, wherein the image data are for representing a to-be-displayed image including a plurality of image pixels; calculating red image sub-pixel data, green image sub-pixel data, blue image sub-pixel data and white image sub-pixel data corresponding to the plurality of image pixels according to the image data, and concretely using grayscale values of a red image sub-pixel, a green image sub-pixel and a blue image sub-pixel of each of the plurality of image pixels as the red image sub-pixel data, the green image sub-pixel data and the blue image sub-pixel data corresponding to the image pixel and using the minimum one of the grayscale values as the white image sub-pixel data corresponding to the image pixel; using six image pixels in the plurality of image pixels as a repeat unit and generating red display sub-pixel data, green display sub-pixel data, blue display sub-pixel data and white display sub-pixel data corresponding to three display pixels in the plurality of display pixels by each repeat unit; and using the red display sub-pixel data, the green display sub-pixel data, the blue display sub-pixel data and the white display sub-pixel data to drive the red display sub-pixels, the green display sub-pixels, the blue display sub-pixels and the white display sub-pixels of corresponding display pixels.

In an embodiment, the step of using six image pixels in the plurality of image pixels as a repeat unit and generating red display sub-pixel data, green display sub-pixel data, blue display sub-pixel data and white display sub-pixel data corresponding to three display pixels in the plurality of display pixels by each repeat unit includes: sharing the red image sub-pixel data and the green image sub-pixel data of a first image pixel and a second image pixel in the six image pixels to generate the red display sub-pixel data and the green display sub-pixel data of a first display pixel in the three display pixels; sharing the blue image sub-pixel data and the white image sub-pixel data of the second image pixel and a third image pixel in the six image pixels to generate the blue display sub-pixel data and the white display sub-pixel data of the first display pixel; sharing the red image sub-pixel data and the green image sub-pixel data of the third image pixel and a fourth image pixel in the six image pixels to generate the red display sub-pixel data and the green display sub-pixel data of a second display pixel in the three display pixels; sharing the blue image sub-pixel data and the white image sub-pixel data of the fourth image pixel and a fifth image pixel in the six image pixels to generate the blue display sub-pixel data and the white display sub-pixel data of the second display pixel; sharing the red image sub-pixel data and the green image sub-pixel data of the fifth image pixel and a sixth image pixel in the six image pixels to generate the red display sub-pixel data and the green display sub-pixel data of a third display pixel in the three display pixels; and sharing the blue image sub-pixel data and the white image sub-pixel data of the sixth image pixel in the six image pixels and a first image pixel in next repeat unit to generate the blue display sub-pixel data and the white display sub-pixel data of the third display pixel.

In an embodiment, the six image pixels are adjacently arranged along a row direction of the to-be-displayed image, and the three display pixels are adjacently arranged along a row direction of the liquid crystal display panel.

In order to solve the above problem, the invention further provides a driving method of a liquid crystal display panel. The liquid crystal display panel includes a plurality of display pixels, and each of the plurality of display pixels includes a red display sub-pixel, a green display sub-pixel, a blue display sub-pixel and a white display sub-pixel. The driving method includes: receiving image data, wherein the image data are for representing a to-be-displayed image including a plurality of image pixels; calculating red image sub-pixel data, green image sub-pixel data, blue image sub-pixel data and white image sub-pixel data corresponding to the plurality of image pixels according to the image data; using a first predetermined number of image pixels in the plurality of image pixels as a repeat unit and generating red display sub-pixel data, green display sub-pixel data, blue display sub-pixel data and white display sub-pixel data corresponding to a second predetermined number of display pixels by using each repeat unit in a pixel sharing manner, wherein the first predetermined number is greater than the second predetermined number; and using the red display sub-pixel data, the green display sub-pixel data, the blue display sub-pixel data and the white display sub-pixel data to drive the red display sub-pixels, the green display sub-pixels, the blue display sub-pixels and the white display sub-pixels of corresponding display pixels.

In an embodiment, the step of calculating red image sub-pixel data, green image sub-pixel data, blue image sub-pixel data and white image sub-pixel data corresponding to the plurality of image pixels according to the image data includes: using grayscale values of a red image sub-pixel, a green image sub-pixel, and a blue image sub-pixel of each of the image pixels as the red image sub-pixel data, the green image sub-pixel data and the blue image sub-pixel data corresponding to the image pixel, and using the minimum one of the grayscale values as the white image sub-pixel data corresponding to the image pixel.

In an embodiment, the step of using a first predetermined number of image pixels in the plurality of image pixels as a repeat unit and generating red display sub-pixel data, green display sub-pixel data, blue display sub-pixel data and white display sub-pixel data corresponding to a second predetermined number of display pixels by using each repeat unit in a pixel sharing manner includes: using six image pixels as the repeat unit and generating the red display sub-pixel data, the green display sub-pixel data, the blue display sub-pixel data and the white display sub-pixel data corresponding to three display pixels by using each repeat unit.

In an embodiment, the step of using six image pixels as the repeat unit and generating the red display sub-pixel data, the green display sub-pixel data, the blue display sub-pixel data and the white display sub-pixel data corresponding to three display pixels by using each repeat unit includes: sharing the red image sub-pixel data and the green image sub-pixel data of a first image pixel and a second image pixel in the six image pixels to generate the red display sub-pixel data and the green display sub-pixel data of a first display pixel in the three display pixels; sharing the blue image sub-pixel data and the white image sub-pixel data of the second image pixel and a third image pixel in the six image pixels to generate the blue display sub-pixel data and the white display sub-pixel data of the first display pixel; sharing the red image sub-pixel data and the green image sub-pixel data of the third image pixel and a fourth image pixel in the six image pixels to generate the red display sub-pixel data and the green display sub-pixel data of a second display pixel in the three display pixels; sharing the blue image sub-pixel data and the white image sub-pixel data of the fourth image pixel and a fifth image pixel in the six image pixels to generate the blue display sub-pixel data and the white display sub-pixel data of the second display pixel; sharing the red image sub-pixel data and the green image sub-pixel data of the fifth image pixel and a sixth image pixel in the six image pixels to generate the red display sub-pixel data and the green display sub-pixel data of a third display pixel in the three display pixel; and sharing the blue image sub-pixel data and the white image sub-pixel data of the sixth image pixel in the six image pixels and a first image pixel of next repeat unit to generate the blue display sub-pixel data and the white display sub-pixel data of the third display pixel.

In an embodiment, the six image pixels are adjacently arranged along a row direction of the to-be-displayed image, and the three display pixels are adjacently arranged along a row direction of the liquid crystal display panel.

In order to solve the above problem, the invention provides a liquid crystal display panel including a plurality of display pixels, each of the plurality of display pixels including a red display sub-pixel, a green display sub-pixel, a blue display sub-pixel and a white display sub-pixel. The red display sub-pixels, the green display sub-pixels, the blue display sub-pixels and the white display sub-pixels in neighboring display pixels respectively at neighboring rows being arranged at respective same columns.

In an embodiment, the liquid crystal display panel further includes: an image buffer unit configured for receiving image data, wherein the image data are for representing a to-be-displayed image including a plurality of image pixels; an image processor configured for calculating red image sub-pixel data, green image sub-pixel data, blue image sub-pixel data and white image sub-pixel data corresponding to the plurality of image pixels according to the image data, using a first predetermined number of image pixels as a repeat unit and generating red display sub-pixel data, green display sub-pixel data, blue display sub-pixel data and white display sub-pixel data corresponding to a second predetermined number of display pixels by using each repeat unit in a pixel sharing manner, wherein the first predetermined number is greater than the second predetermined number; and a display driver configured for using the red display sub-pixel data, the green display sub-pixel data, the blue display sub-pixel data and the white display sub-pixel data to drive the red display sub-pixels, the green display sub-pixels, the blue display sub-pixels and the white display sub-pixels of corresponding display pixels.

In an embodiment, the image processor concretely is configured for using grayscale values of a red image sub-pixel, a green image sub-pixel and a blue image sub-pixel of each of the plurality of image pixels as the red image sub-pixel data, the green image sub-pixel data and the blue image sub-pixel data corresponding to the image pixel and using the minimum one of the grayscale values as the white image sub-pixel data corresponding to the image pixel.

In an embodiment, the image processor concretely is configured for using six image pixels as a repeat unit and generating the red display sub-pixel data, the green display sub-pixel data, the blue display sub-pixel data and the white display sub-pixel data corresponding to three display pixels by each repeat unit.

In an embodiment, the image processor is configured for executing following steps that: sharing the red image sub-pixel data and the green image sub-pixel data of a first image pixel and a second image pixel in the six image pixels to generate the red display sub-pixel data and the green display sub-pixel data of a first display pixel in the three display pixels; sharing the blue image sub-pixel data and the white image sub-pixel data of the second image pixel and a third image pixel in the six image pixels to generate the blue display sub-pixel data and the white display sub-pixel data of the first display pixel; sharing the red image sub-pixel data and the green image sub-pixel data of the third image pixel and a fourth image pixel in the six image pixels to generate the red display sub-pixel data and the green display sub-pixel data of a second display pixel in the three display pixels; sharing the blue image sub-pixel data and the white image sub-pixel data of the fourth image pixel and a fifth image pixel in the six image pixels to generate the blue display sub-pixel data and the white display sub-pixel data of the second display pixel; sharing the red image sub-pixel data and the green image sub-pixel data of the fifth image pixel and a sixth image pixel in the six image pixels to generate the red display sub-pixel data and the green display sub-pixel data of a third display pixel in the three display pixels; and sharing the blue image sub-pixel data and the white image sub-pixel data of the sixth image pixel in the six image pixels and a first image pixel in next repeat unit to generate the blue display sub-pixel data and the white display sub-pixel data of the third display pixel.

The efficacy can be achieved by the invention is that: different from the prior art, the liquid crystal display panel and the driving there of according to the invention can effectively improve the edge blur phenomenon by the image pixel sharing manner.

BRIEF DESCRIPTION OF THE DRAWINGS

In order to more clearly illustrate the technical solutions of various embodiments of the present invention, drawings will be used in the description of embodiments will be given a brief description below. Apparently, the drawings in the following description only are some embodiments of the invention, the ordinary skill in the art can obtain other drawings according to these illustrated drawings without creative effort. In the drawings:

FIG. 1 is a schematic view of a RGB pixel arrangement of a first liquid crystal display panel in the prior art;

FIG. 2 is a schematic view of a RGBW pixel arrangement of a second liquid crystal display panel in the prior art;

DETAILED DESCRIPTION OF EMBODIMENTS

In the following, with reference to accompanying drawings of embodiments of the invention, technical solutions in the embodiments of the invention will be clearly and completely described. Apparently, the embodiments of the invention described below only are a part of embodiments of the invention, but not all embodiments. Based on the described embodiments of the invention, all other embodiments obtained by ordinary skill in the art without creative effort belong to the scope of protection of the invention.

Figure 3:
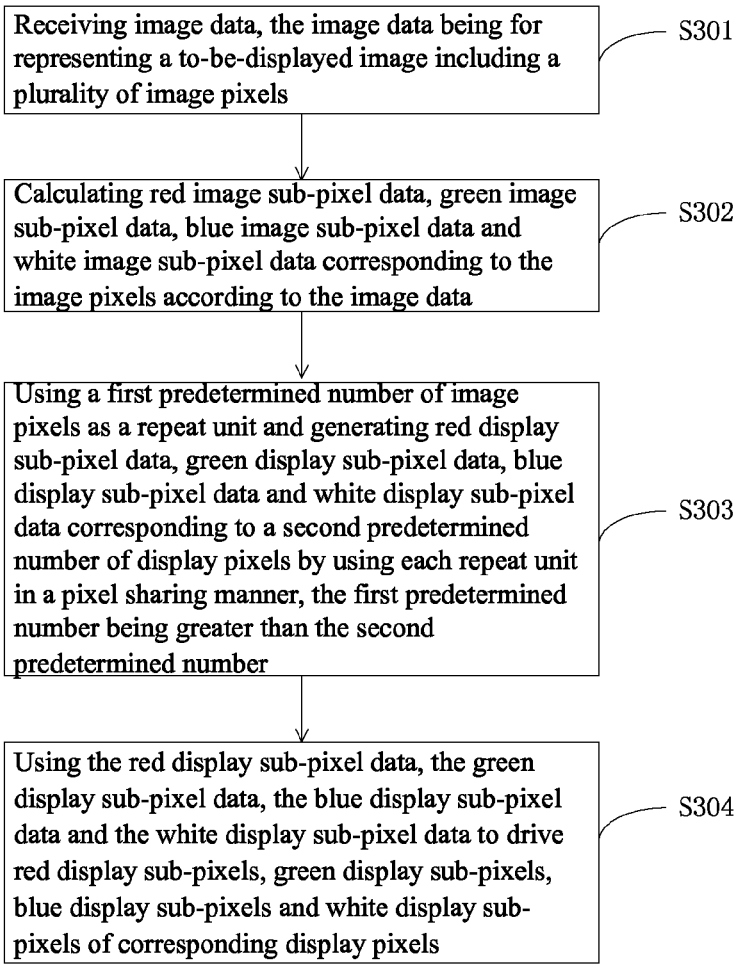
FIG. 3 is a flowchart of an embodiment of a driving method of a liquid crystal display panel of the invention.

Referring to FIG. 3, a flowchart of an embodiment of a driving method of a liquid crystal display panel of the invention is shown. The liquid crystal display panel in this embodiment includes a plurality of display pixels DP. Each of the display pixels includes a red display sub-pixel DP_R, a green display sub-pixel DP_G, a blue display sub-pixel DP_B and a white display sub-pixel DP_W.

The liquid crystal display panel is configured (i.e., structured and arranged) for realizing the display of image, and concretely using a plurality of display pixels DP of the liquid crystal display panel to correspondingly display a plurality of image pixels IP of a to-be-display image. Because the image pixels IP of the to-be-displayed image have different colors, and therefore in this embodiment, the display pixels DP corresponding to the image pixels IP each have four display sub-pixels DP_R, DP_G, DP_B and DP_W for realizing the display of different colors.

In this embodiment, by controlling grayscale values of the four display sub-pixels DP_R, DP_G, DP_B and DP_W, the corresponding display pixel DP can exhibit different colors and thereby achieve the display of image. Moreover, the liquid crystal display panel in this embodiment has the white display sub-pixel DP_W, when a light source strikes on the white display sub-pixel DP_W, the white light is allowed to pass therethrough, the transmittance is higher than that of the other display sub-pixels and thus the brightness of the liquid crystal display panel correspondingly is increased.

In particular, in this embodiment, the driving method of the above-described liquid crystal display panel includes the following steps that:

S301: receiving image data, the image data being for representing a to-be-displayed image including a plurality of image pixels.

As noted above, the display pixels DP of the liquid crystal display panel correspondingly display the image pixels IP of the to-be-display image, in order to realize the display process, the liquid crystal display panel needs to determine a color will be displayed by each display pixel DP, and therefore the liquid crystal display panel uses a data processing to determine the color to be displayed by each display pixel DP and uses the data to drive the display pixels DP so as to realize the display. The above operations of the liquid crystal display panel all are corresponded to the to-be-displayed image, and therefore firstly it is needed to receive image data IPD of the to-be-displayed image, generally speaking, the image data IPD are obtained by dividing the image into a plurality of image pixels IP and then parsing the image pixels IP, and thus the image data IPD represent a to-be-displayed image including a plurality of image pixels IP.

S302: calculating red image sub-pixel data, green image sub-pixel data, blue image sub-pixel data and white image sub-pixel data corresponding to the image pixels according to the image data.

In order to realize the driving of the display sub-pixels of the display pixels DP, after receiving the image data IPD, it is needed to calculate a red image sub-pixel data IPD_R, a green image sub-pixel data IPD_G, a blue image sub-pixel data IPD_B and a white image sub-pixel data IPD_W corresponding to each image pixel IP according to the image data IPD.

Figure 4:
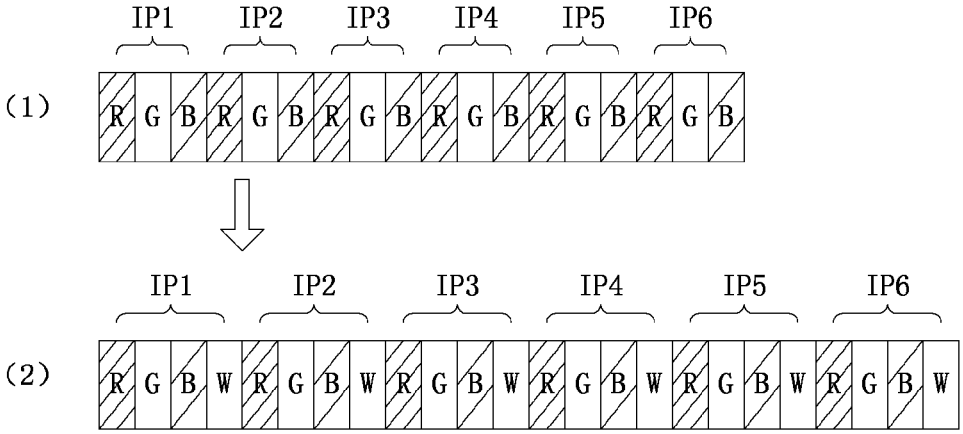
FIG. 4 is a schematic view of a process of obtaining image sub-pixel data corresponding to image pixels according to image data in the driving method of the invention.

Please refer to FIG. 4, a schematic view of a process of obtaining image sub-pixel data corresponding to the image pixels according to the image data is shown. Because the image data IPD are corresponded to the image pixels IP, the image sub-pixel data are corresponded to the image sub-pixels, for the convenience of description, in FIG. 4, the image data are represented by the image pixels IP, FIG. 4 (1) uses RGB three image sub-pixel data to represent the received image data, and then RGBW four image sub-pixel data as shown in FIG. 4(2) are obtained by calculation according to the image data.

Concretely speaking, the grayscale values of the red image sub-pixel IP_R, the green image sub-pixel IP_G and the blue image sub-pixel IP_B of each image pixel IP are used as the red image sub-pixel data IP_R, the green image sub-pixel data IPD_G and the blue image sub-pixel data IPD_B of the image pixel IP, and the minimum one of the grayscale values is used as the white image sub-pixel data IPD_W of the image pixel IP.

Because each display pixels DP displays the corresponding image pixel IP by controlling the grayscale values of the display sub-pixels, and therefore the grayscale values can be used as data for driving the display sub-pixels to achieve an effective display of the display pixel DP, and the grayscale values of the image sub-pixels are used as image sub-pixel data. For the white image sub-pixel data IPD_W, because the white image sub-pixel IP_W corresponding thereto is for increasing the transmittance, and therefore the minimum grayscale value in this embodiment is used as the white image sub-pixel data IPD_W, the use of minimum grayscale value would not excessively affect the saturation of the display pixel DP and meanwhile can provide a relatively high transmittance. In other embodiment, an image processing algorithm can be used to calculate a certain grayscale value for the white image sub-pixel IP_W, and the calculated grayscale value is used as the white image sub-pixel data IPD_W.

S303: using a first predetermined number of image pixels as a repeat unit and generating red display sub-pixel data, green display sub-pixel data, blue display sub-pixel data and white display sub-pixel data corresponding to a second predetermined number of display pixels by using each repeat unit in a pixel sharing manner, the first predetermined number being greater than the second predetermined number.

In order to display an image on the liquid crystal display panel, it is needed to correspond the image pixel data IPD to the display pixels DP, and therefore it is needed to generate red display sub-pixel data DPD_R, green display sub-pixel data DPD_G, blue display sub-pixel data DPD_B and white display sub-pixel data DPD_W corresponding to the display pixels DP for driving the display sub-pixels.

In this embodiment, the first predetermined number A of image pixels IP are used as a repeat unit for processing, each repeat unit is used to generate display sub-pixel data corresponding to the second predetermined number B of display pixels DP in a pixel sharing manner, where A is greater than B. By such sharing manner, a number b of the display sub-pixels on the liquid crystal display panel can be smaller than or equal to a number a of the image sub-pixels divided as RGB. Therefore, the liquid crystal display panel in this embodiment, compared with the traditional RGB liquid crystal display panel, can use less number of pixels to reach the same or higher image resolution, and the less number of pixels can make the manufacturing process of the liquid crystal display panel be much easier, the yield in the production process correspondingly is higher and the cost can be reduced in disguise. Moreover, the edge blur phenomenon can be effectively improved.

For the step S303, a concrete example will be described as follows only for the purpose of illustration. In particular, the first predetermined number is set as six, i.e., A=6, and the six image pixels are adjacently arranged along a direction of to-be-displayed image row; the second predetermined number is set as three, i.e., B=3, and the three display pixels are adjacently arranged along a row direction of the liquid crystal display panel.

The six image pixels then are used as a repeat unit, and each repeat unit is used to generate red display sub-pixel data, green display sub-pixel data, blue display sub-pixel data and white display sub-pixel data corresponding to the three display pixels in a pixel sharing manner.

Figure 5:
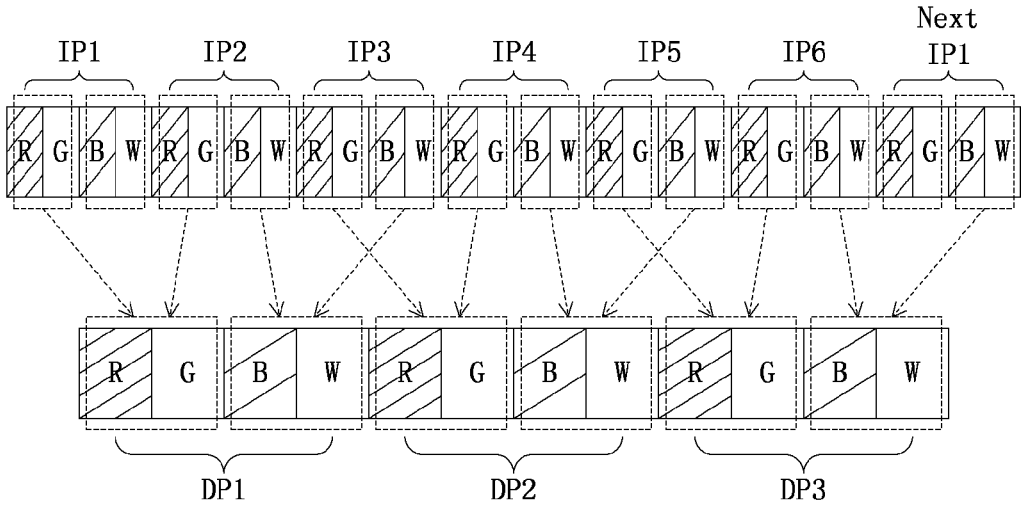
FIG. 5 is a schematic view of a process of generating display sub-pixel data corresponding to three display pixels by using six image pixels in a pixel sharing manner in the driving method of the invention.

Please refer to FIG. 4 and FIG. 5, and FIG. 5 is a schematic view of a process of generating display sub-pixel data corresponding to the three display pixels by using the six image pixels in a sharing manner. In FIG. 5, the display pixel data DPD also are represented by the display pixels DP.

The six image pixels are used to obtain corresponding image sub-pixel data by the calculation process (as shown in FIG. 4) in the step S302, the obtained image sub-pixel data then are shared to generate corresponding display sub-pixel data. A concrete sharing process will be described with reference to FIG. 5. In FIG. 5, the six image pixels respectively are denoted as IP1, IP2, . . . , IP6, the image sub-pixels are denoted by blocks labeled by RGBW; and in the following description, the red image sub-pixel of the image pixel IP1 is represented by IP1_R, and the corresponding image sub-pixel data is represented by IPD1_R (the representations of other image sub-pixels are similar to these). The three display pixels respectively are represented by DP1, DP2, DP3, and display sub-pixels thereof also are represented by RGBW blocks; and in the following description, the red display sub-pixel of the display pixel DP1 is represented by DP1_R, and the corresponding display sub-pixel data is represented by DPD1_R (the representations of the other display sub-pixels are similar to these). The concrete sharing process is as follows:

The red image sub-pixel data IPD1_R, IPD2_R and the green image sub-pixel data IPD1_G, IPD2_G of the first image pixel IP1 and the second image pixel IP2 in the six image pixels are shared to generate the red display sub-pixel data DPD1_R and the green display sub-pixel data DPD1_G of the first display pixel DP1 in the three display pixels.

The blue image sub-pixel data IPD2_B, IPD3_B and the white image sub-pixel data IPD2_W, IPD3_W of the second image pixel IP2 and the third image pixel IP3 in the six image pixels are shared to generate the blue display sub-pixel data DPD1_B and the white display sub-pixel data DPD1_W of the first display pixel DP1.

The red image sub-pixel data IPD3_R, IPD4_R and the green image sub-pixel data IPD3_G, IPD4_G of the third image pixel IP3 and the fourth image pixel IP4 in the six image pixels are shared to generate the red display sub-pixel data DPD2_R and the green display sub-pixel data DPD2_G of the second display pixel DP2 in the three display pixels.

The blue image sub-pixel data IPD4_B, IPD5_B and the white image sub-pixel data IPD4_W, IPD5_W of the fourth image pixel IP4 and the fifth image pixel IP5 in the six image pixels are shared to generate the blue display sub-pixel data DPD2_B and the white display sub-pixel data DPD2_W of the second display pixel DP2.

The red image sub-pixel data IPD5_R, IPD6_R and the green image sub-pixel data IPD5_G, IPD6_G of the fifth image pixel IP5 and the sixth image pixel IP6 in the six image pixels are shared to generate the red display sub-pixel data DPD3_R and the green display sub-pixel data DPD3_G of the third display pixel DP3 in the three display pixels.

The blue image sub-pixel data IPD6_B, NextIPD1_B and the white image sub-pixel data IPD6_W, NextIPD1_W of the sixth image pixel IP6 in the six image pixel and the first image pixel NextIP1 in next repeat unit are shared to generate the blue display sub-pixel data DPD3_B and the white display sub-pixel data DPD3_W of the third display pixel DP3.

It can be found from FIG. 4(1) that, if the traditional RGB liquid crystal display panel is employed, each image pixel IP is divided into three RGB image sub-pixels, if the number of image pixels A=6, then the number of the image sub-pixels a=3×6=18, and thus the traditional liquid crystal display panel correspondingly needs the number of display sub-pixels b=a=18.

As to the liquid crystal display panel in this embodiment, please refer to FIG. 5, each image pixel IP is divided into RGBW four image sub-pixels, if the number of image pixels A=6, then the number of image sub-pixels a=4×6=24, because the image sub-pixels are corresponded to the display sub-pixels in a sharing manner, in conjunction with FIG. 5 and the above sharing process, the number of display sub-pixels b=a÷2=12, that is, the number of the display sub-pixels required by the liquid crystal display panel is 12.

Accordingly, the number of display sub-pixels of the liquid crystal display panel in this embodiment is reduced to ⅔ number of display sub-pixels of the traditional liquid crystal display panel in the situation of the two display panels parsing the same number of image pixels. Correspondingly, the manufacturing process of the liquid crystal display panel in this embodiment is much easier, the yield in the production process is higher and the cost is reduced in disguise.

It can be understood that, in the step S303, other number of image pixels can be used as a repeat unit instead, and the number preferably is an even number, and also may be an odd number. If the even numbers 4, 8 are taken as examples, the 4 or 8 number of image pixels may be adjacently arranged along the direction of the to-be-displayed image column, and correspondingly the 2 or 4 number of display pixels are adjacently arranged along the column direction of the liquid crystal display panel.

S304: using the red display sub-pixel data, the green display sub-pixel data, the blue display sub-pixel data and the white display sub-pixel data to drive red display sub-pixels, green display sub-pixels, blue display sub-pixels and white display sub-pixels of corresponding display pixels.

After the display sub-pixel data are obtained, by using the obtained display sub-pixel data to drive the corresponding display sub-pixels, the display sub-pixels can display different colors with certain grayscale values and thereby the display of image is achieved.

In summary, different from the prior art, in the driving method of the liquid crystal display panel in this embodiment, the liquid crystal display panel includes a plurality of display pixels, each display pixel includes red, green, blue and white four display sub-pixels, the added white display sub-pixel can effectively increase the light transmittance of the display panel. Moreover, the driving method of the liquid crystal display panel includes the following steps of: firstly receiving image data capable of representing a to-be-displayed image including a plurality of image pixels and calculating image sub-pixel data corresponding to the image pixels according to the image data; then using a first predetermined number of image pixels as a repeat unit and generating display sub-pixel data corresponding to a second predetermined number of display pixels by suing each repeat unit in a pixel sharing manner; and finally using the display sub-pixel data to drive the display sub-pixels of corresponding display pixels for image display, the first predetermined number being greater than the second predetermined number. By such pixel sharing manner, the pixel number of the display panel can be reduced, a high image resolution can be provided by less pixel number, and the edge blur phenomenon can be effectively improved.

Figure 6:
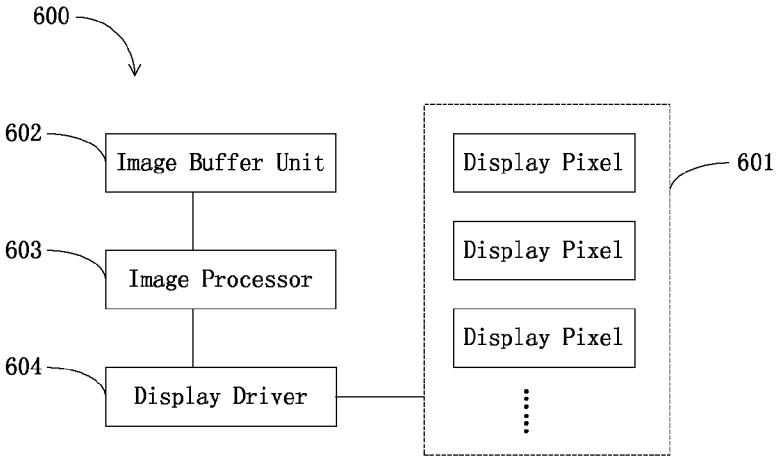
FIG. 6 is a structural schematic view of an embodiment of a liquid crystal display panel of the invention.

Referring to FIG. 6, a structural schematic view of an embodiment of a liquid crystal display panel of the invention is shown. The liquid crystal display panel 60 provided in this embodiment includes a plurality of display pixels 601, an image buffer unit 602, an image processor 603 and a display driver 604.

Figure 7:
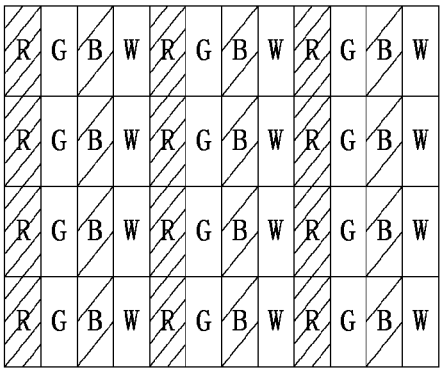
FIG. 7 is a schematic view of a first pixel arrangement of display pixels in the liquid crystal display panel of the invention.

As to the display pixels 601, please refer to FIG. 7, a schematic view of an embodiment of a pixel arrangement of display pixels in the liquid crystal display panel of the invention is shown. In FIG. 7, each display pixel has RGBW four display sub-pixels.

The image buffer unit 602 is configured (i.e., structured and arranged) for receiving image data. The image data are for representing a to-be-displayed image including a plurality of image pixels.

The image processor 603 is configured for calculating red image sub-pixel data, green image sub-pixel data, blue image sub-pixel data and white image sub-pixel data corresponding to the plurality of image pixels according to the image data in the image buffer unit 602, using a first predetermined number of image pixels as a repeat unit and generating red display sub-pixel data, green display sub-pixel data, blue display sub-pixel data and white display sub-pixel data corresponding to a second predetermined number of display pixels 602 by using each repeat unit in a pixel sharing manner, the first predetermined number being greater than the second predetermined number.

Concretely, the image processor 603 uses grayscale values of a red image sub-pixel, a green image sub-pixel and a blue image sub-pixel of each image pixel as the red image sub-pixel data, the green image sub-pixel data and the blue image sub-pixel data of the image pixel, and further uses the minimum one of the grayscale values as the white image sub-pixel data the image pixel. Of course, the grayscale value of the white image sub-pixel can be calculated by an image processing algorithm embedded in the image processor 603, and then the calculated grayscale value is used as the white image sub-pixel data.

Furthermore, the image processor 603 for example uses six image pixels as a repeat unit and generates red display sub-pixel data, green display sub-pixel data, blue display sub-pixel data and white display sub-pixel data corresponding to three display pixels by each repeat unit.

The image processor 603 concretely executes the following steps that:

sharing the red image sub-pixel data and the green image sub-pixel data of a first image pixel and a second image pixel in the six image pixels to generate the red display sub-pixel data and the green display sub-pixel data of a first display pixel in the three display pixels;

sharing the blue image sub-pixel data and the white image sub-pixel data of the second image pixel and a third image pixel in the six image pixels to generate the blue display sub-pixel data and the white display sub-pixel data of the first display pixel;

sharing the red image sub-pixel data and the green image sub-pixel data of the third image pixel and a fourth image pixel in the six image pixels to generate the red display sub-pixel data and the green display sub-pixel data of a second display pixel in the three display pixels;

sharing the blue image sub-pixel data and the white image sub-pixel data of the fourth image pixel and a fifth image pixel in the six image pixels to generate the blue display sub-pixel data and the white display sub-pixel data of the second display pixel;

sharing the red image sub-pixel data and the green image sub-pixel data of the fifth image pixel and a sixth image pixel in the six image pixels to generate the red display sub-pixel data and the green display sub-pixel data of a third display pixel in the three display pixels; and sharing the blue image sub-pixel data and the white image sub-pixel data of the sixth image pixel in the six image pixels and a first image pixel in next repeat unit to generate the blue display sub-pixel data and the white display sub-pixel data of the third display pixel.

The display driver 604 is configured for using the red display sub-pixel data, the green display sub-pixel data, the blue display sub-pixel data and the white display sub-pixel data to drive the red display sub-pixels, the green display sub-pixels, the blue display sub-pixels and the white display sub-pixels of corresponding display pixels 601.

A process of the liquid crystal display panel 600 realizing the display is similar to the process in the above driving method of the invention, and functions and operation processes of the above parts of the liquid crystal display panel 600 are corresponding to the various steps in the above embodiment of the driving method of the invention, and therefore the same description will not be repeated herein.

It is indicated that, as to the pixel arrangement as shown in FIG. 7, the pixel sharing process executed by the image processor 603 is similar to the step S303 in the above embodiment of the driving method of the invention, and thus will be not repeated herein.

Moreover, the liquid crystal display panel in this embodiment has the sub-pixel W, which can effectively increase the transmittance. In addition, the red display sub-pixels R, the green display sub-pixels G, the blue display sub-pixels B and the white display sub-pixels W in neighboring display pixels respectively at neighboring rows are arranged respective same columns as shown in FIG. 7, i.e., display sub-pixels arranged in a same column have the same color, so that the edge blur problem caused by the staggered arrangement can be avoided and the good display quality can be ensured.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all such modifications and similar structures.

What is claimed is:

1. A driving method of a liquid crystal display panel, wherein the liquid crystal display panel comprises a plurality of display pixels, each of the plurality of display pixels comprises a red display sub-pixel, a green display sub-pixel, a blue display sub-pixel and a white display sub-pixel; the driving method comprises:

receiving image data, wherein the image data are for representing a to-be-displayed image including a plurality of image pixels;

calculating red image sub-pixel data, green image sub-pixel data, blue image sub-pixel data and white image sub-pixel data corresponding to the plurality of image pixels according to the image data; and concretely using grayscale values of a red image sub-pixel, a green image sub-pixel and a blue image sub-pixel of each of the plurality of image pixels as the red image sub-pixel data, the green image sub-pixel data and the blue image sub-pixel data corresponding to the image pixel and using the minimum one of the grayscale values as the white image sub-pixel data corresponding to the image pixel;

using six image pixels in the plurality of image pixels as a repeat unit and generating red display sub-pixel data, green display sub-pixel data, blue display sub-pixel data and white display sub-pixel data corresponding to three display pixels in the plurality of display pixels by each repeat unit;

using the red display sub-pixel data, the green display sub-pixel data, the blue display sub-pixel data and the white display sub-pixel data to drive the red display sub-pixels, the green display sub-pixels, the blue display sub-pixels and the white display sub-pixels of corresponding display pixels.

2. The driving method as claimed in claim 1, wherein the step of using six image pixels in the plurality of image pixels as a repeat unit and generating red display sub-pixel data, green display sub-pixel data, blue display sub-pixel data and white display sub-pixel data corresponding to three display pixels in the plurality of display pixels by each repeat unit comprises:

sharing the red image sub-pixel data and the green image sub-pixel data of a first image pixel and a second image pixel in the six image pixels to generate the red display sub-pixel data and the green display sub-pixel data of a first display pixel in the three display pixels;

sharing the blue image sub-pixel data and the white image sub-pixel data of the second image pixel and a third image pixel in the six image pixels to generate the blue display sub-pixel data and the white display sub-pixel data of the first display pixel;

sharing the red image sub-pixel data and the green image sub-pixel data of the third image pixel and a fourth image pixel in the six image pixels to generate the red display sub-pixel data and the green display sub-pixel data of a second display pixel in the three display pixels;

sharing the blue image sub-pixel data and the white image sub-pixel data of the fourth image pixel and a fifth image pixel in the six image pixels to generate the blue display sub-pixel data and the white display sub-pixel data of the second display pixel;

sharing the red image sub-pixel data and the green image sub-pixel data of the fifth image pixel and a sixth image pixel in the six image pixels to generate the red display sub-pixel data and the green display sub-pixel data of a third display pixel in the three display pixels; and sharing the blue image sub-pixel data and the white image sub-pixel data of the sixth image pixel in the six image pixels and a first image pixel in next repeat unit to generate the blue display sub-pixel data and the white display sub-pixel data of the third display pixel.

3. The driving method as claimed in claim 2, wherein the six image pixels are adjacently arranged along a row direction of the to-be-displayed image, and the three display pixels are adjacently arranged along a row direction of the liquid crystal display panel.

4. A driving method of a liquid crystal display panel, wherein the liquid crystal display panel comprises a plurality of display pixels, each of the plurality of display pixels comprises a red display sub-pixel, a green display sub-pixel, a blue display sub-pixel and a white display sub-pixel; the driving method comprises:

receiving image data, wherein the image data are for representing a to-be-displayed image including a plurality of image pixels;

calculating red image sub-pixel data, green image sub-pixel data, blue image sub-pixel data and white image sub-pixel data corresponding to the plurality of image pixels according to the image data;

using a first predetermined number of image pixels in the plurality of image pixels as a repeat unit and generating red display sub-pixel data, green display sub-pixel data, blue display sub-pixel data and white display sub-pixel data corresponding to a second predetermined number of display pixels by using each repeat unit in a pixel sharing manner, wherein the first predetermined number is greater than the second predetermined number;

using the red display sub-pixel data, the green display sub-pixel data, the blue display sub-pixel data and the white display sub-pixel data to drive the red display sub-pixels, the green display sub-pixels, the blue display sub-pixels and the white display sub-pixels of corresponding display pixels.

5. The driving method as claimed in claim 4, wherein the step of calculating red image sub-pixel data, green image sub-pixel data, blue image sub-pixel data and white image sub-pixel data corresponding to the plurality of image pixels according to the image data comprises:

using grayscale values of a red image sub-pixel, a green image sub-pixel, and a blue image sub-pixel of each of the image pixels as the red image sub-pixel data, the green image sub-pixel data and the blue image sub-pixel data corresponding to the image pixel, and using the minimum one of the grayscale values as the white image sub-pixel data corresponding to the image pixel.

6. The driving method as claimed in claim 4, wherein the step of using a first predetermined number of image pixels in the plurality of image pixels as a repeat unit and generating red display sub-pixel data, green display sub-pixel data, blue display sub-pixel data and white display sub-pixel data corresponding to a second predetermined number of display pixels by using each repeat unit in a pixel sharing manner comprises:

using six image pixels as the repeat unit and generating the red display sub-pixel data, the green display sub-pixel data, the blue display sub-pixel data and the white display sub-pixel data corresponding to three display pixels by using each repeat unit.

7. The driving method as claimed in claim 6, wherein the step of using six image pixels as the repeat unit and generating the red display sub-pixel data, the green display sub-pixel data, the blue display sub-pixel data and the white display sub-pixel data corresponding to three display pixels by using each repeat unit comprises:

sharing the red image sub-pixel data and the green image sub-pixel data of a first image pixel and a second image pixel in the six image pixels to generate the red display sub-pixel data and the green display sub-pixel data of a first display pixel in the three display pixels;

sharing the blue image sub-pixel data and the white image sub-pixel data of the second image pixel and a third image pixel in the six image pixels to generate the blue display sub-pixel data and the white display sub-pixel data of the first display pixel;

sharing the red image sub-pixel data and the green image sub-pixel data of the third image pixel and a fourth image pixel in the six image pixels to generate the red display sub-pixel data and the green display sub-pixel data of a second display pixel in the three display pixels;

sharing the blue image sub-pixel data and the white image sub-pixel data of the fourth image pixel and a fifth image pixel in the six image pixels to generate the blue display sub-pixel data and the white display sub-pixel data of the second display pixel;

sharing the red image sub-pixel data and the green image sub-pixel data of the fifth image pixel and a sixth image pixel in the six image pixels to generate the red display sub-pixel data and the green display sub-pixel data of a third display pixel in the three display pixel;

sharing the blue image sub-pixel data and the white image sub-pixel data of the sixth image pixel in the six image pixels and a first image pixel of next repeat unit to generate the blue display sub-pixel data and the white display sub-pixel data of the third display pixel.

8. The driving method as claimed in claim 7, wherein the six image pixels are adjacently arranged along a row direction of the to-be-displayed image, and the three display pixels are adjacently arranged along a row direction of the liquid crystal display panel.

9. A liquid crystal display panel comprising a plurality of display pixels, each of the plurality of display pixels including a red display sub-pixel, a green display sub-pixel, a blue display sub-pixel and a white display sub-pixel, the red display sub-pixels, the green display sub-pixels, the blue display sub-pixels and the white display sub-pixels in neighboring display pixels respectively at neighboring rows being arranged at respective same columns;

an image buffer unit, configured for receiving image data, wherein the image data are for representing a to-be-displayed image including a plurality of image pixels;

an image processor, configured for calculating red image sub-pixel data, green image sub-pixel data, blue image sub-pixel data and white image sub-pixel data corresponding to the plurality of image pixels according to the image data, using a first predetermined number of image pixels as a repeat unit and generating red display sub-pixel data, green display sub-pixel data, blue display sub-pixel data and white display sub-pixel data corresponding to a second predetermined number of display pixels by using each repeat unit in a pixel sharing manner, wherein the first predetermined number is greater than the second predetermined number; and a display driver, configured for using the red display sub-pixel data, the green display sub-pixel data, the blue display sub-pixel data and the white display sub-pixel data to drive the red display sub-pixels, the green display sub-pixels, the blue display sub-pixels and the white display sub-pixels of corresponding display pixels.

10. The liquid crystal display panel as claimed in claim 9, wherein the image processor concretely is configured for using grayscale values of a red image sub-pixel, a green image sub-pixel and a blue image sub-pixel of each of the plurality of image pixels as the red image sub-pixel data, the green image sub-pixel data and the blue image sub-pixel data corresponding to the image pixel and using the minimum one of the grayscale values as the white image sub-pixel data corresponding to the image pixel.

11. The liquid crystal display panel as claimed in claim 9, wherein the image processor concretely is configured for using six image pixels as a repeat unit and generating the red display sub-pixel data, the green display sub-pixel data, the blue display sub-pixel data and the white display sub-pixel data corresponding to three display pixels by each repeat unit.

12. The liquid crystal display panel as claimed in claim 11, the image processor is configured for executing following steps that:

sharing the red image sub-pixel data and the green image sub-pixel data of a first image pixel and a second image pixel in the six image pixels to generate the red display sub-pixel data and the green display sub-pixel data of a first display pixel in the three display pixels;

sharing the blue image sub-pixel data and the white image sub-pixel data of the second image pixel and a third image pixel in the six image pixels to generate the blue display sub-pixel data and the white display sub-pixel data of the first display pixel;

sharing the red image sub-pixel data and the green image sub-pixel data of the third image pixel and a fourth image pixel in the six image pixels to generate the red display sub-pixel data and the green display sub-pixel data of a second display pixel in the three display pixels;

sharing the blue image sub-pixel data and the white image sub-pixel data of the fourth image pixel and a fifth image pixel in the six image pixels to generate the blue display sub-pixel data and the white display sub-pixel data of the second display pixel;

sharing the red image sub-pixel data and the green image sub-pixel data of the fifth image pixel and a sixth image pixel in the six image pixels to generate the red display sub-pixel data and the green display sub-pixel data of a third display pixel in the three display pixels;

sharing the blue image sub-pixel data and the white image sub-pixel data of the sixth image pixel in the six image pixels and a first image pixel in next repeat unit to generate the blue display sub-pixel data and the white display sub-pixel data of the third display pixel.

* * * * *